US009164413B2

(12) United States Patent
Kanehara

(10) Patent No.: US 9,164,413 B2
(45) Date of Patent: Oct. 20, 2015

(54) IMAGE FORMING APPARATUS

(71) Applicant: BROTHER KOGYO KABUSHIKI KAISHA, Nagoya-shi, Aichi-ken (JP)

(72) Inventor: Kohei Kanehara, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/336,013

(22) Filed: Jul. 21, 2014

(65) Prior Publication Data

US 2015/0023677 A1 Jan. 22, 2015

(30) Foreign Application Priority Data

Jul. 22, 2013 (JP) ..... 2013-151509

(51) Int. Cl.
*G03G 15/02* (2006.01)

(52) U.S. Cl.
CPC ..... *G03G 15/0266* (2013.01); *G03G 15/0291* (2013.01)

(58) Field of Classification Search
CPC ..... G03G 15/0266; G03G 15/0291
See application file for complete search history.

(56) References Cited

U.S. PATENT DOCUMENTS 5,132,869 A * 7/1992 Nakaya ..... 361/233
5,450,180 A * 9/1995 Ohzeki et al. ..... 399/50
5,646,717 A * 7/1997 Hiroshima et al. ..... 399/154
5,903,183 A * 5/1999 Inukai ..... 327/540
5,999,760 A * 12/1999 Suzuki et al. ..... 399/45
6,205,299 B1 * 3/2001 Kusaka et al. ..... 399/45
2006/0024074 A1 2/2006 Maeda et al.
2007/0212087 A1 * 9/2007 Sakata ..... 399/50
2008/0232837 A1 * 9/2008 Endo ..... 399/66
2010/0080593 A1 4/2010 Inukai et al.
2010/0092192 A1 * 4/2010 Sakata ..... 399/50
2010/0278547 A1 11/2010 Maruyama et al.

(Continued)

FOREIGN PATENT DOCUMENTS

JP H03-142483 A 6/1991
JP 05006112 A * 1/1993

(Continued)

OTHER PUBLICATIONS

Office Action from corresponding U.S. Appl. No. 13/627,463 issued on Feb. 25, 2014 (10 pages).

(Continued)

*Primary Examiner* — David Gray
*Assistant Examiner* — Sevan A Aydin
(74) *Attorney, Agent, or Firm* — Merchant & Gould PC

(57) ABSTRACT

An image forming apparatus, comprising: an attachment unit to which a load for image formation is attached; an applying circuit configured to apply an applying voltage to the load; a voltage detection circuit configured to detect the applying voltage; a current detection unit configured to detect a load current; and a control device, wherein the control device is configured to: subject the applying circuit to constant current control in accordance with a detected value of the current detection unit so that the load current becomes a target current; and switch to a constant voltage control by which the applying voltage is controlled to become a target voltage when an absolute value of the load current is smaller than a determination value and an absolute value of the applying voltage is larger than or equal to a threshold during execution of the constant current control.

9 Claims, 9 Drawing Sheets

(56) References Cited

U.S. PATENT DOCUMENTS

| | | | | |
|---|---|---|---|---|
| 2012/0027436 | A1 | 2/2012 | Maruyama et al. | |
| 2012/0027437 | A1 | 2/2012 | Maruyama et al. | |
| 2012/0051762 | A1 | 3/2012 | Maruyama et al. | |
| 2012/0051772 | A1 | 3/2012 | Inukai | |
| 2012/0082470 | A1 | 4/2012 | Inukai et al. | |
| 2013/0108295 | A1 | 5/2013 | Kanehara et al. | |
| 2013/0195472 | A1 * | 8/2013 | Takami | 399/13 |
| 2014/0265552 | A1 * | 9/2014 | Maekawa et al. | 307/2 |
| 2014/0328604 | A1 * | 11/2014 | Tanaka et al. | 399/66 |

FOREIGN PATENT DOCUMENTS

| | | | | |
|---|---|---|---|---|
| JP | 08114989 | A | * | 5/1996 |
| JP | 09185221 | A | * | 7/1997 |
| JP | 2003-345194 | A | | 12/2003 |
| JP | 2006-047490 | A | | 2/2006 |
| JP | 2006091481 | A | * | 4/2006 |
| JP | 2008-191521 | A | | 8/2008 |
| JP | 2010-102289 | A | | 5/2010 |
| JP | 2012-032531 | A | | 2/2012 |
| JP | 2013-097042 | A | | 5/2013 |

OTHER PUBLICATIONS

Notice of Allowance from corresponding U.S. Appl. No. 13/627,463 issued on Jun. 11, 2014 (5 pages).

Related application as filed Sep. 26, 2012; U.S. Appl. No. 13/627,463 (now allowed).

* cited by examiner

IMAGE FORMING APPARATUS

CROSS-REFERENCE TO RELATED APPLICATION

This application claims priority under 35 U.S.C. §119 from Japanese Patent Application No. 2013-151509, filed on Jul. 22, 2013. The entire subject matter of the application is incorporated herein by reference.

BACKGROUND

1. Technical Field

Aspects of the present invention relate to an image forming apparatus, and in particular to technology for suppressing increase of an applying voltage in a state where no load is attached.

2. Related Art

In general, in an image forming apparatus an output of a charge voltage applying circuit is controlled to keep a grid current constant so that a charge amount for a photosensitive drum becomes larger than or equal to a predetermined value (constant current control). During the constant current control, an output voltage of the charge voltage applying circuit is monitored, and when the output voltage gets larger than the upper limit, control for the charge voltage applying circuit is switched from the constant current control to constant voltage control so as to suppress abnormal discharge of a charger.

SUMMARY

However, if the image forming apparatus tries to perform constant current control for a current flowing through a load in a state where actually a load, such as a charger or a transfer roller, to which a high voltage is to be applied is not attached to a body of the image forming apparatus, an applying voltage may rapidly increase so as to increase the current of the load to a target value.

Aspects of the present invention are advantageous in that they provide an image forming apparatus capable of suppressing increase of an applying voltage even when a situation where a high voltage is applied in a non-load state arises.

According to an aspect of the invention, there is provided an image forming apparatus, comprising: an attachment unit to which a load for image formation is attached; an applying circuit configured to apply an applying voltage to the load attached to the attachment unit; a voltage detection circuit configured to detect the applying voltage outputted by the applying circuit; a current detection unit configured to detect a load current produced by application of the applying voltage to the load by the applying circuit; and a control device. In this configuration, the control device is configured to: subject the applying circuit to constant current control in accordance with a detected value of the current detection unit so that the load current for the load for image formation becomes a target current; and switch to a constant voltage control by which the applying voltage is controlled to become a target voltage when an absolute value of the load current detected by the current detection unit is smaller than a determination value and an absolute value of the applying voltage detected by the voltage detection circuit is larger than or equal to a threshold during execution of the constant current control.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereafter, embodiments according to the invention will be described with reference to the accompanying drawings.

First Embodiment

Hereafter, a first embodiment is described with reference to FIGS. 1 to 9.

1. Overall Configuration

Figure 2:
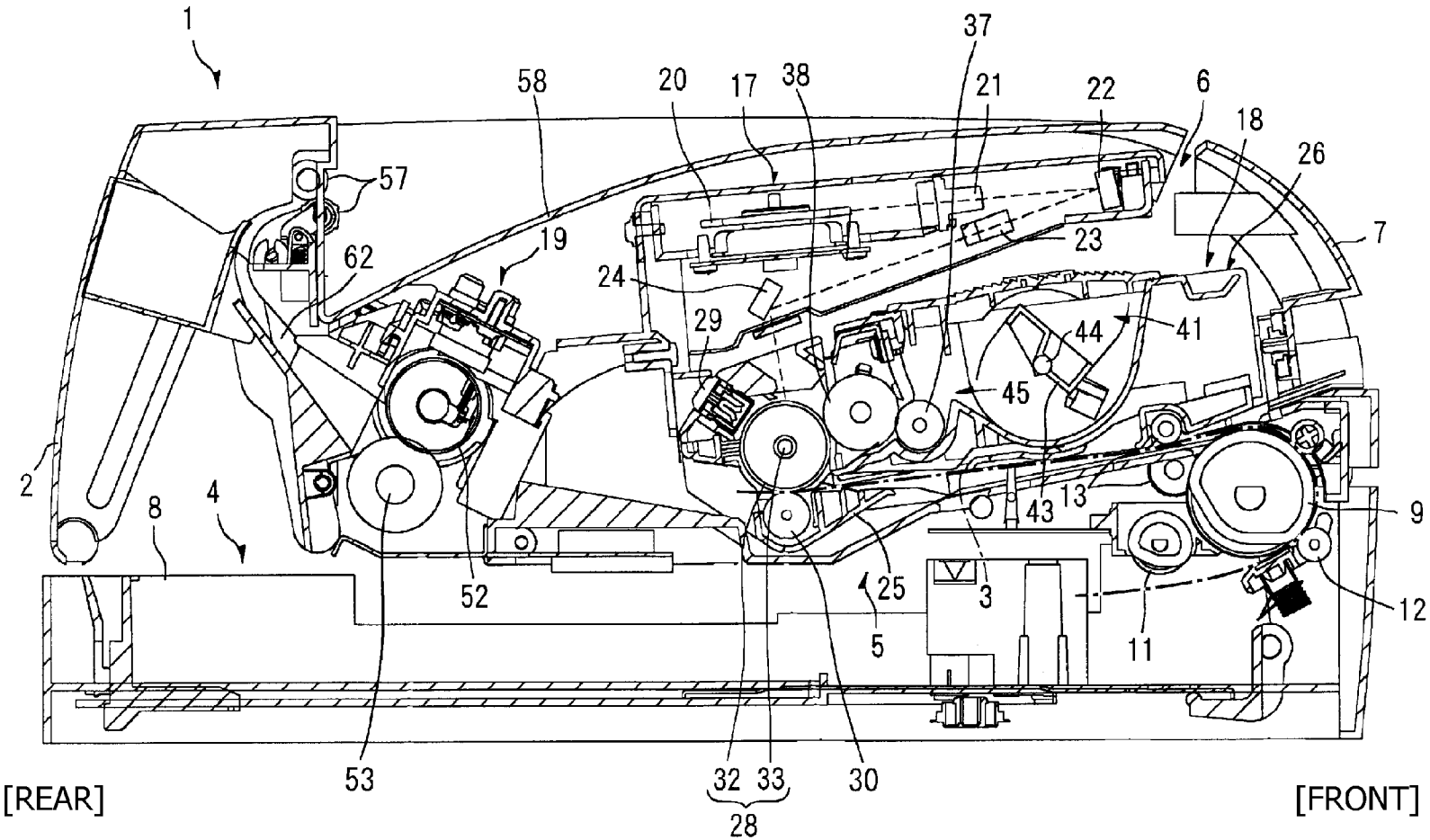
FIG. 2 is a side cross section of the printer.

In the following, a side on which a cover 7 is provided is referred to as a "front side" (the right side in FIG. 2), and an opposite side is referred to as a "rear side" (the left side in FIG. 2).

Figure 1:
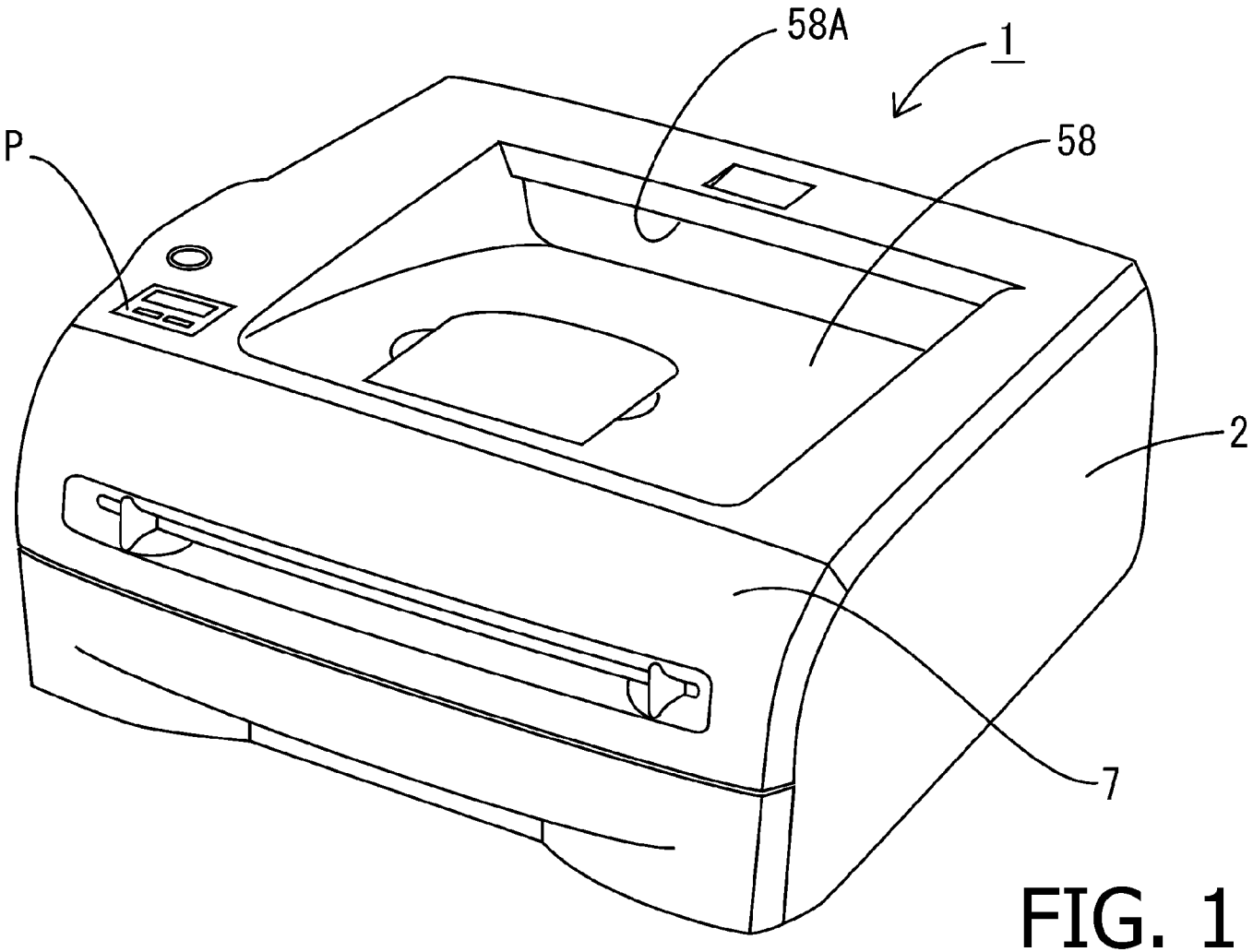
FIG. 1 is a perspective view of a laser printer (hereafter, simply referred to as a printer) as an example of an image forming apparatus.

As shown in FIG. 1, a printer 1 is entirely covered with a box-shaped body casing 2. An upper surface wall of the body casing 2 is formed as a paper discharge tray 58. That is, in a portion forming a back side wall of the paper discharge tray 58, a paper discharge opening 58A is formed, and a sheet of paper 3 which has been subjected to image formation is discharged from the back side to the front side through the paper discharge opening 58A. Further, in one end portion on the front edge of the paper discharge tray 58, an operation panel P is provided on the upper surface wall of the body casing 2.

Next, an internal configuration of the printer 1 is explained with reference to FIG. 2. The body casing 2 is provided with a feeder part 4 which supplies the sheet of paper 3 which is an example of a recording medium, and an image formation unit 5 which forms an image on the supplied sheet of paper 3.

On one side wall of the body casing 2, an attachment/detachment opening 6 for attaching or detaching a process cartridge 18 which is described later is formed, and a cover 7 which opens or closes the attachment/detachment opening 6 is provided. The cover 7 is rotatably supported by a cover shaft (not shown). The process cartridge 18 is detachably attachable to an attachment part 2A in the body casing 2. When the cover 7 is opened, the process cartridge 18 can be withdrawn from the body casing 2 through the attachment/ detachment opening 6. In the body casing 2, two terminals T1 and T2 are provided. When the process cartridge 18 is attached to the attachment part 2A of the body casing 2, a discharge wire 29B and a grid electrode 29C of a charger 29 are respectively connected to a high voltage power circuit 110 via the two terminals T1 and T2 (see FIG. 5).

The feeder part 4 is principally constituted by a paper supply tray 8 which is provided on a bottom part in the body casing 2, and various rollers disposed in the front end portion of the paper supply tray 8. The various rollers include a paper supply roller 9, a pick-up roller 11, a pinch roller 12 and a registration roller 13.

The image formation unit 5 includes a scanner unit 17, the process cartridge 18 and a fixing unit 10. The scanner unit 17 is provided in an upper portion of the body casing 2, and includes a laser source (not shown), a polygonal mirror 20 which is driven to rotate, an fθ lens 21, a reflection mirror 22, a lens 23 and a reflection mirror 24. As shown by a dashed line in FIG. 2, a laser beam which is emitted from the laser source based on image data is deflected by the polygonal mirror 20, and is bent by the reflection mirror 22 after passing through the fθ lens 21. Then, the laser beam is bent downward by the reflection mirror 24 after passing through the lens 23. Thus, the laser beam scans on a surface of a photosensitive drum 28 of the process cartridge 18 at a high speed.

The process cartridge 18 includes a photosensitive body cartridge 25, and a development cartridge 26 which is detachable attachable to the photosensitive body cartridge 25. In the process cartridge 18, the photosensitive body cartridge 25 is provided generally on the left side with respect to a boundary line G indicated in FIG. 3, and includes the photosensitive drum 28, the charger 29 and a transfer roller 30.

The photosensitive drum 28 includes a cylindrical drum body 32 which is formed of a positive charge type photosensitive layer whose outermost layer is formed of, for example, polycarbonate, and a metal drum shaft 33 extending along the longer direction of the drum body 32. The drum shaft 33 is connected to a ground (so-called "drum ground").

Figure 5:
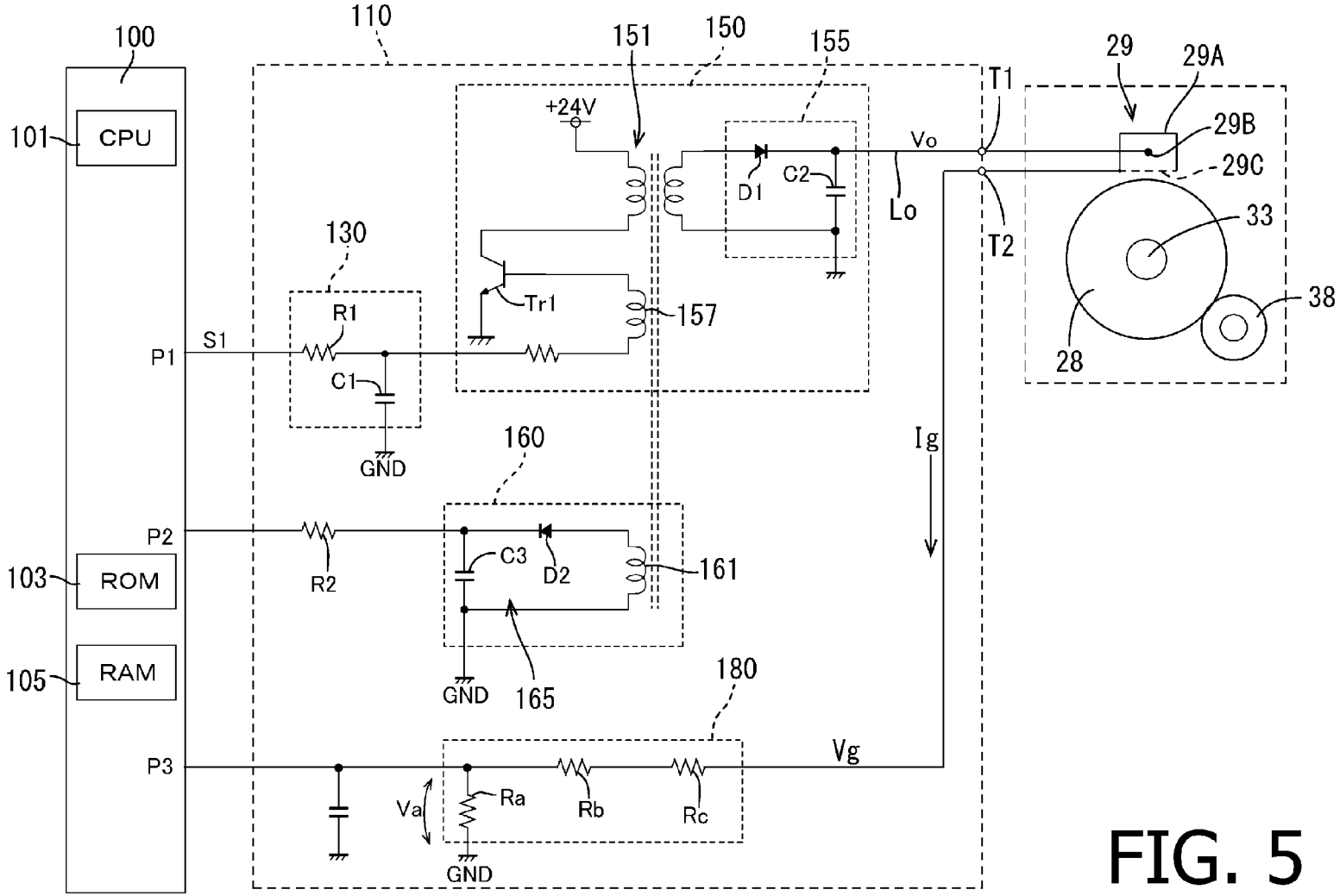
FIG. 5 is a circuit diagram for a control device, a high voltage power circuit and the process cartridge.

The charger 29 is a scorotron type charger for positive charge which generates corona discharge from an electrical discharge wire for charging, such as tungsten, and includes a shielding case 29A, a discharge wire 29B and a metal grid electrode 29C as shown in FIG. 5. The shielding case 29A has a shape of a long square tube elongated in the rotation axis direction of the photosensitive drum 28. A plane of the shielding case 29A facing the photosensitive drum 28 is opened as a discharge opening.

The discharge wire 29B is formed of, for example, a tungsten wire. The discharge wire 29B is provided to extend in the axis direction in the shielding case 29A. To the discharge wire 29A, a high voltage is applied from a charge voltage applying circuit 150 which is described later. Through application of a high voltage, the discharge wire 29B generates corona discharge in the shielding case 29A. Ions generated by the corona discharge flow, as a discharge current, from the discharge opening to the photosensitive drum 28 side, and thereby the surface of the photosensitive drum 28 is charged positively and uniformly.

The grid electrode 29C is a plate-like member having a slit or a through hole, and is attached to the discharge opening of the shielding case 29A. By controlling the voltage applied to the grid electrode 29C, it is possible to control the surface voltage of the photosensitive drum 28.

The transfer roller 30 is disposed to face and contact the photosensitive drum 28 from the lower side in the vertical direction, and to form a nip with respect to the photosensitive drum 28. The transfer roller 30 is applied a transfer bias during the transferring.

Figure 3:
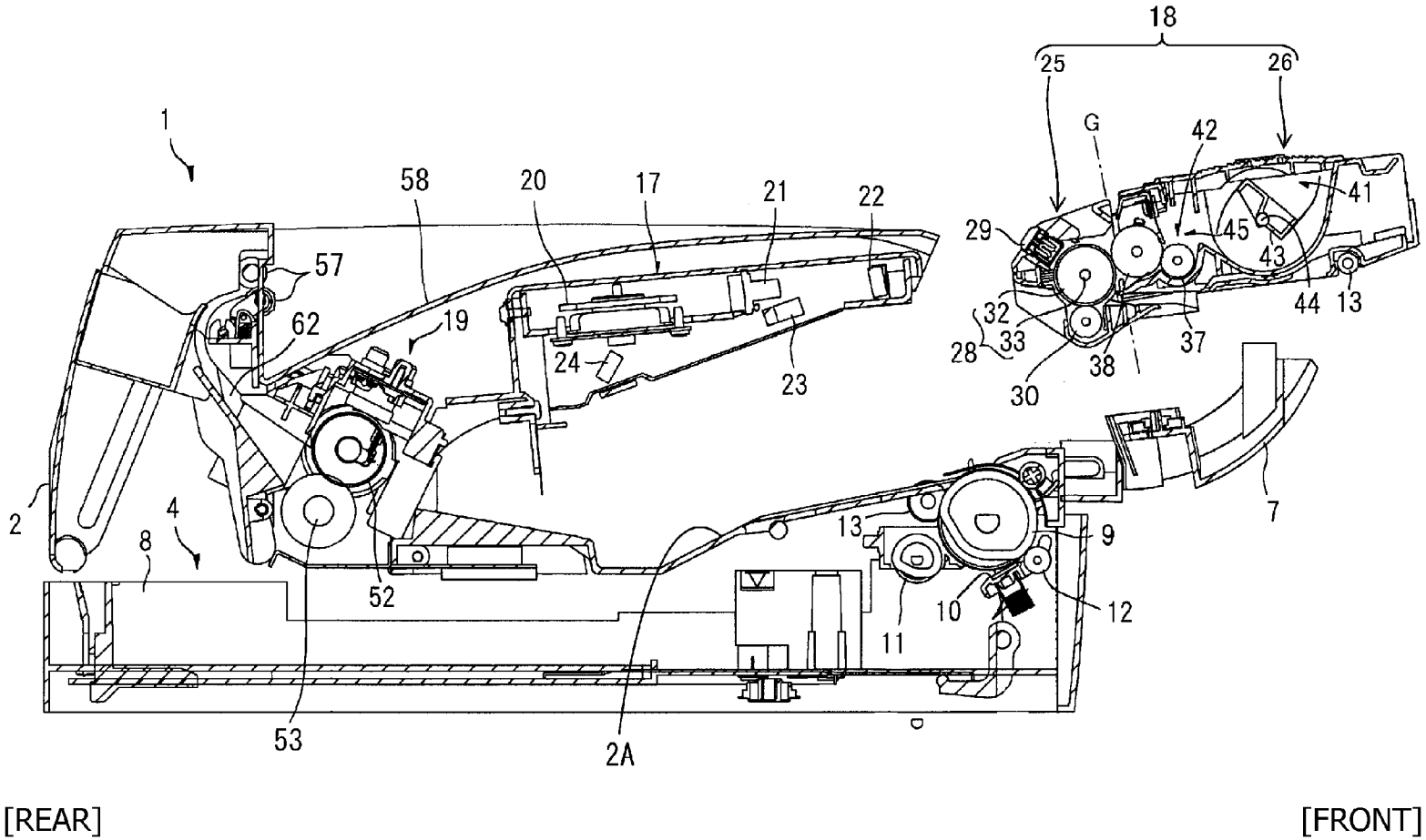
FIG. 3 is a side cross section of the printer illustrating a state where a process cartridge is removed from the printer.

In the process cartridge 18, the development cartridge 26 is generally provided on the right side with respect to the boundary line G indicated in FIG. 3. The development cartridge 26 includes a supply roller 37 and a development roller 38, and stores toner which is a developer in an inner toner reservoir 41.

The toner reservoir 41 is provided with an agitator 43. By being rotated about an agitator shaft 44 as a fulcrum, the agitator 43 agitates the toner in the toner reservoir 41 and discharges the toner toward a development chamber 42 from a toner discharge opening 45.

The development roller 38 includes a roller shaft and a rubber roller made of conductive rubber which covers the circumference of the roller shaft. A development voltage is applied to the roller shaft of the development roller 38. The development roller 38 serves to supply the toner to the photosensitive drum 28 while causing the toner being supplied via the supply roller 37 to be positively charged by the effect of the development voltage.

The fixing unit 19 includes a heat roller 52 and a press roller 53. The heat roller 52 is provided with a heater formed of a halogen lamp therein along the axis direction, and the surface of the heat roller 52 is heated to the fixing temperature. In the fixing unit 19, the toner transferred to the sheet of paper 3 is thermally fixed while the sheet of paper 3 passes through a space between the heat roller 52 and the press roller 53.

A sequence of image formation process executed in the printer 1 configured as described above will be explained briefly. When the printer 1 receives print date (see FIG. 4), a print process is started. As a result, in accordance with rotations of the photosensitive drum 28, the surface of the photosensitive drum 28 is charged positively and uniformly by the charger 29 (a charge process). Then, the laser light is emitted from the scanner unit 17 which is an example of an exposure device toward the photosensitive drum 28 (an exposure process). As a result, an electrostatic latent image corresponding to the print data is formed on the surface of the photosensitive drum 28. That is, on the positively and uniformly charged surface of the photosensitive drum 28, the potential of a part of the surface irradiated with the laser light decreases.

Next, in accordance with rotations of the development roller 38, the toner which is positively charged and held on the development roller 38 is supplied to the electrostatic latent image formed on the surface of the photosensitive drum 28. As a result, the electrostatic latent image on the photosensitive drum 28 is visualized, and a toner image by reversal development is held on the surface of the photosensitive drum 28 (a development process).

Concurrently with the above described process for forming a toner image, a process for conveying the sheet of paper 3 is performed. That is, the sheet of paper 3 is sent out one by one from the paper supply tray 8 to a paper conveying path. The sheet of paper 3 sent out to the paper conveying path is conveyed by a conveying roller 11, to a transfer position where the photosensitive drum 28 and the transfer roller 30 contact with each other.

When the sheet of paper 3 passes through the transfer position, the toner image held on the surface of the photosensitive drum 28 is transferred to the surface of the sheet of paper 3 by a transfer bias applied to the transfer roller 30 (a transfer process). Thus, a toner image is formed on the sheet of paper 3. The transferred toner image is thermally fixed while the sheet of paper 3 passes through the fixing unit 19 (a fixing process). Thereafter, the sheet of paper 3 is conveyed to a paper discharge path, and is discharged on the paper discharge tray 58 formed on the upper surface o the body casing 2.

2. Electric Configuration of Printer 1

Figure 4:
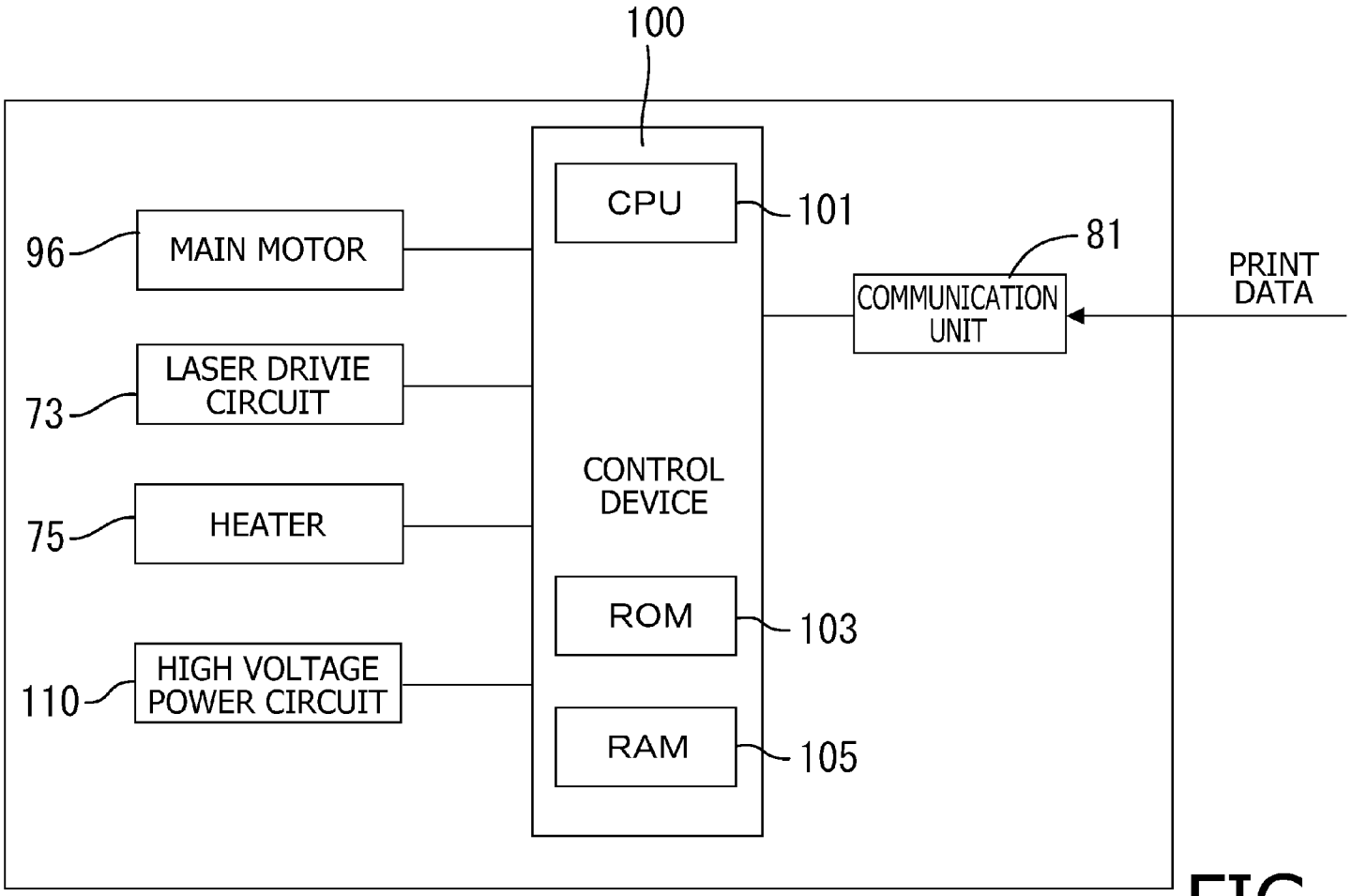
FIG. 4 is a block diagram illustrating an electric configuration of the printer.

Hereafter, an electric configuration of the printer 1 is explained. As shown in FIG. 4, the printer 1 includes a main motor 96, a laser drive circuit 73 which drives the laser source, a heater 75 which heats the heat roller 52, a high voltage power circuit 110 which generates a charge voltage to be applied to the charger 29 and a grid voltage to be applied to the grid electrode 29C, a communication unit 91 and a control device 100. The main motor 96 drives and rotates rotational bodies in the process cartridge 18, such as the photosensitive drum 28, the development roller 38, the agitator 43 and the supply roller 37, and rotational bodies in a paper conveying unit, such as the supply roller 9 and the pick-up roller 11.

The communication unit 81 communicates with an information processing apparatus, such as a PC (Personal Computer), and serves to receive a print command and print data from the information processing apparatus. The control device 100 includes a CPU 101, a ROM 103 and a RAM 105, and has the function of totally controlling the printer 1 for controlling a sequence of image formation process including a charge process, an exposure process, a development process, a transfer process and a fixing process, and the function of controlling the high voltage power circuit 110.

The ROM 103 stores a program for executing a control flow for the charge voltage applying circuit 150 which is described later, and various types of data required for executing the program. The various types of data include a first threshold, a second threshold, a first target voltage, a second target voltage and a determination value.

3. Configuration of High Voltage Power Circuit

The high voltage power circuit 110 is implemented as a circuit mounted on a high voltage circuit board provided in the body casing 2 of the printer 1. As shown in FIG. 5, the high voltage power circuit 110 includes a first PWM signal smoothing circuit 130, a charge voltage applying circuit (an applying circuit for a charger) 150, a voltage detection circuit 160 and a grid voltage generation circuit 180.

The first PWM signal smoothing circuit 130 is an integrating circuit including a resistor R1 and a capacitor C1, and is configured to smooth a PWM signal S1 outputted from an output port P1 of the control device 100, and to output the smoothed signal to a base of a transistor Tr1 provided in the charge voltage applying circuit 150.

The charge voltage applying circuit 150 generates a high voltage (a charge voltage) of approximately 4.5 kV to 8 kV from an input voltage of DC 24V, and serves to apply the high voltage to the charger 29. In the printer 1, the charge voltage applying circuit 150 is configured as a self-exciting flyback converter (RCC). The charge voltage applying circuit 150 includes a transformer 151, a rectifying and smoothing circuit 155 provided on the secondary-side of the transformer 151, and the transistor Tr1 provided on the primary-side of the transformer 151.

The transistor Tr1 executes switching for the transformer 151. An emitter of the transistor Tr1 is grounded, and a collector of the transistor Tr1 is connected to a primary winding of the transformer 151. The base of the transistor Tr1 is connected to the first PWM signal smoothing circuit 130 via a primary-side subsidiary winding (feedback coil) 157 of the transformer 151.

An output line $L_O$ of the charge voltage applying circuit 150 is connected to the terminal T1 provided in the body casing 2. When the process cartridge 18 is attached to the body casing 2, the discharge wire 29B of the charger 29 is electrically connected to the terminal T1. Therefore, the output voltage (corresponding to an applying voltage) Vo of the charge voltage applying circuit 150 is applied to the discharge wire 29B of the charger 29 through the terminal T1.

The voltage detection circuit 160 detects the output voltage $V_O$ of the charge voltage applying circuit 150. The voltage detection circuit 160 includes a subsidiary winding 161 provided on the primary side of the transformer 151, and a rectifying and smoothing circuit 165 including a diode D2 and a capacitor C3. The voltage detection circuit 160 is connected to an input port P2 of the control device 100 via a resistor R2. A detected value of the voltage detection circuit 160, i.e., data of the output voltage $V_O$ of the charge voltage applying circuit 150, is inputted to the input port P2 of the control device 100.

The grid voltage generation circuit 180 includes three resistors Ra, Rb and Rc which are connected in series. The grid voltage generation circuit 180 is configured such that the terminal T2 provided in the body casing 2 is grounded via the three resistors Ra, Rb and Rc. As shown in FIG. 5, one side of each of the resistors Ra, Rb and Rc (specifically, one side of the resistor Ra) are connected to the grounds, and other side of each of the resistors Ra, Rb and Rc (specifically, the other end of the resistor Rc) are connected to the terminal T2 provided in the body casing 2.

When the process cartridge 18 is attached to the body casing 2, the grid electrode 29C of the charger 29 is electrically connected to the terminal T2. Therefore, when the output voltage $V_O$ is applied to the charger 29 by driving the charge voltage applying circuit 150, the charger 29 discharges and the grid current (the load current) Ig flows from the grid electrode 29C to the ground.

When the grid current Ig flows, the voltage Vg is generated at the both ends of the three resistors Ra, Rb and Rc, and thereby the voltage Vg is applied to the grid electrode 29C.

$$Vg=Ig\times(Ra+Rb+Rc)$$

Of the three resistors Ra, Rb and Rc connected in series, the resistor Ra serves as a detection resistor which detects the magnitude of the grid current Ig. As shown n FIG. 5, the joint point between the resistors Ra and Rb is connected to an input port P3 of the control device 100 via a signal line. Since the voltage Va which is proportional to the grid current Ig is generated at both ends of the resistor Ra, it is possible to detect the magnitude of the grid current Ig flowing through the grid electrode 29C by checking the voltage level of the input port P3 of the control device 100.

4. Constant Current Control for Grid Current and Voltage Increase in State of No Load In the printer 1, the control device 100, the charge voltage applying circuit 150, the charger 29 and the resistor 29A constitute a feedback system. The control device 100 executes the feedback control so that the grid current Ig flowing through the grid electrode 29C of the charger 29 is kept at a target value (e.g., 200 μA). That is, the control device 100 monitors the magnitude of the grid current Ig, and calculates the deviation X by comparing the grid current Ig with the target value. The control device 100 controls the grid current Ig to be kept at the target value (e.g., 200 μA) by adjusting a PWM value (a duty ratio) of the PWM signal S1 in accordance with the deviation X and by adjusting the output voltage $V_O$ of the charge voltage applying circuit 150. For example, when the grid current Ig is smaller than the target value, it is possible to keep the grid current Ig at the target value by increasing the PWM value of the PWM signal S1 and thereby increasing the output voltage $V_O$ of the charge voltage applying circuit 150. The gird current Ig is substantially in proportional to the discharge current flowing from the charger 29 to the photosensitive drum 28. Therefore, by executing the constant current control to keep the grid current Ig at the target value, it is possible to control the discharge current flowing through the photosensitive drum 28 to be kept at a reference level, and thereby the charge amount of the photosensitive drum 28 becomes an appropriate level for keeping the image quality.

However, when the process cartridge 18 is not attached (hereafter, referred to a "no-load state"), the terminal T2 is opened, and therefore no grid current Ig flows through the resistor Ra. When the constant current control is executed in this state, the control device 100 rapidly increased the PWM value of the PWM signal S1 so as to increase the grid current Ig to the target value. Therefore, the output voltage $V_O$ of the charge voltage applying circuit 150 exceeds an assumed use range E (e.g., 4.5 kV to 8.2 kV) of the output voltage $V_O$ in an actual use state where the charger 29 is actually used for executing the image formation process, and increases to the maximum output value. The maximum output value means the output voltage $V_O$ when the status is the no-load status and the PWM value of the PWM signal S1 is 100. In this embodiment, the maximum output value is, for example, 10 kV.

Considering the case where the output voltage $V_O$ of the charge voltage applying circuit 150 increases to the maximum output value (10 kV), it is necessary to increase the withstand voltage of components (e.g., the diode D1 and the capacitor C2) constituting the charge voltage applying circuit 150. In this example, since the estimated use range of the output voltage $V_O$ in the actual use state is 4.5 kV to 8.2 kV, it becomes necessary to increase the withstand voltage at least by 2 kV, which increases costs.

In the printer 1, control of the charge voltage applying circuit 150 is switched from the constant current control to the first constant voltage control when both the following conditions (1) and (2) stand, by monitoring the grid current Ig and the output voltage $V_O$. The first constant voltage control is executed for controlling the output voltage of the charge voltage applying circuit 150 to the first target value of 7.2 kV.

(1) The grid current Ig detected by the resistor Ra is smaller than the determination value (S20: NO).
(2) The output voltage $V_O$ of the charge voltage applying circuit 150 detected by the voltage detection circuit 160 is larger than or equal to the first threshold (S40: YES).

The first threshold of the output voltage Vo is a value defined within the assumed use range E (4.5 kV to 8.2 kV in this example) of the output voltage $V_O$ in the actual use state, and is 7 kV in this example. The determination value of the grid current Ig is smaller than the grid current Ig which flows when the voltage of the first threshold (7 kV) is applied actually to the discharge wire 29B of the charger 29. In this example, when the voltage of 7 kV is applied to the discharge wire 29B, the grid current Ig of approximately 100 μA flows, and therefore the determination value is set for 50 μA which is smaller than grid current Ig of 100 μA.

As described above, by switching control for the charge voltage applying circuit 150 from the constant current control to the first constant voltage control, the output voltage $V_O$ of the charge voltage applying circuit 150 is controlled to the first target voltage of 7.2 kV after the switching. Therefore, the output voltage $V_O$ of the charge voltage applying circuit 150 never increases to the maximum output of 10 kV, and thereby is becomes possible to suppress the peak of the output voltage $V_O$ of the charge voltage applying circuit 150.

Figure 8:
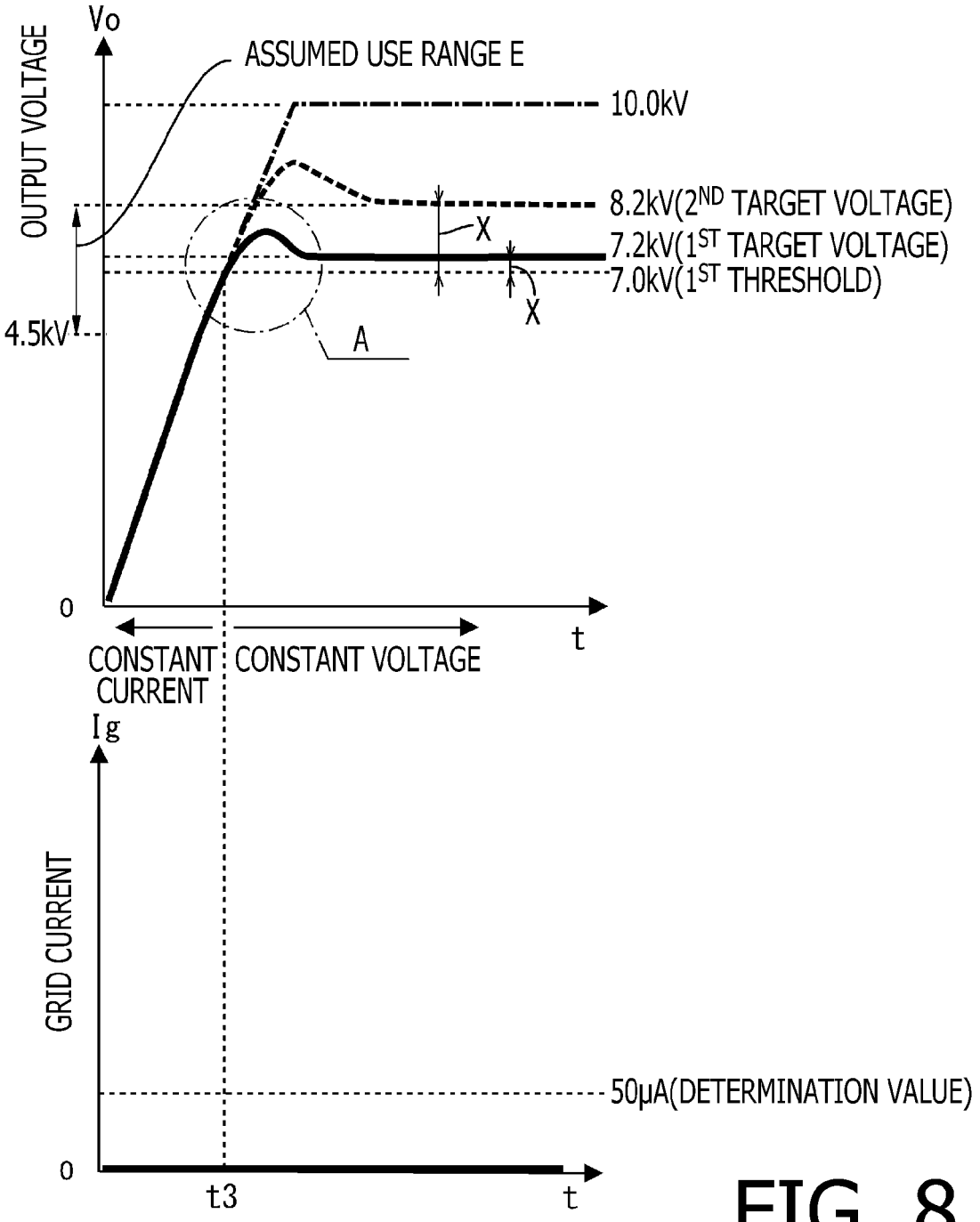
FIG. 8 illustrates graphs showing transition of the output voltage of the charge voltage applying circuit and the grid current in a no load state.
Figure 9:
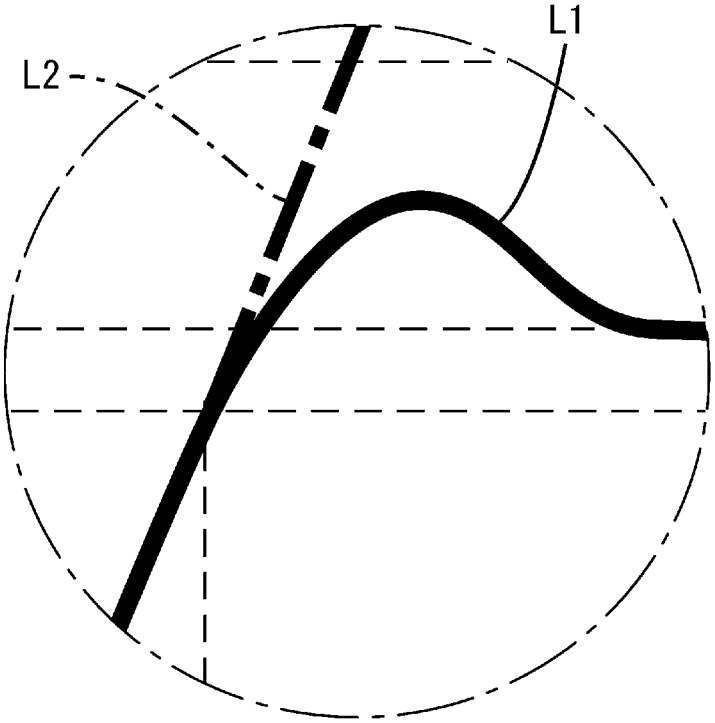
FIG. 9 is an enlarged view of a part A in FIG. 8.

Furthermore, after the switching of control, the output voltage $V_O$ converges to the first target value of 7.2 kV while causing overshoot as shown by a curve of a solid line in FIG. 8. Therefore, it is necessary to suppress the overshoot so that the peak is suppressed. At the time of switching to the first constant voltage control, the output voltage $V_O$ of the charge voltage applying circuit 150 is 7 kV which is smaller than the first target value of 7.2 kV. Therefore, the charge voltage applying circuit 150 is controlled to increase the output. However, as the output voltage $V_O$ increases, the deviation X with respect to the first target value decreases, and therefore the level of feedback becomes weak. As a result, the increasing curve (a curve indicated by a solid line L1 in FIG. 9) of the output voltage $V_O$ of the charge voltage applying circuit 150 becomes gentler than the increasing curve during the constant current control (a curve indicated by a chain line in FIG. 9). Accordingly, the overshoot of the output voltage $V_O$ becomes small.

In the state where the process cartridge 18 is properly attached, when the output voltage $V_O$ becomes larger than or equal to the first threshold of 7 kV, the grid current Ig of approximately 100 μA flows, and becomes larger than or equal to the determination value of 50 μA. Therefore, in the state where the process cartridge 18 is properly attached, control for the charge voltage applying circuit 150 does not switch unintentionally from the constant current control to the first constant voltage control.

5. Control Flow for Charge Voltage Applying Circuit

Figure 6:
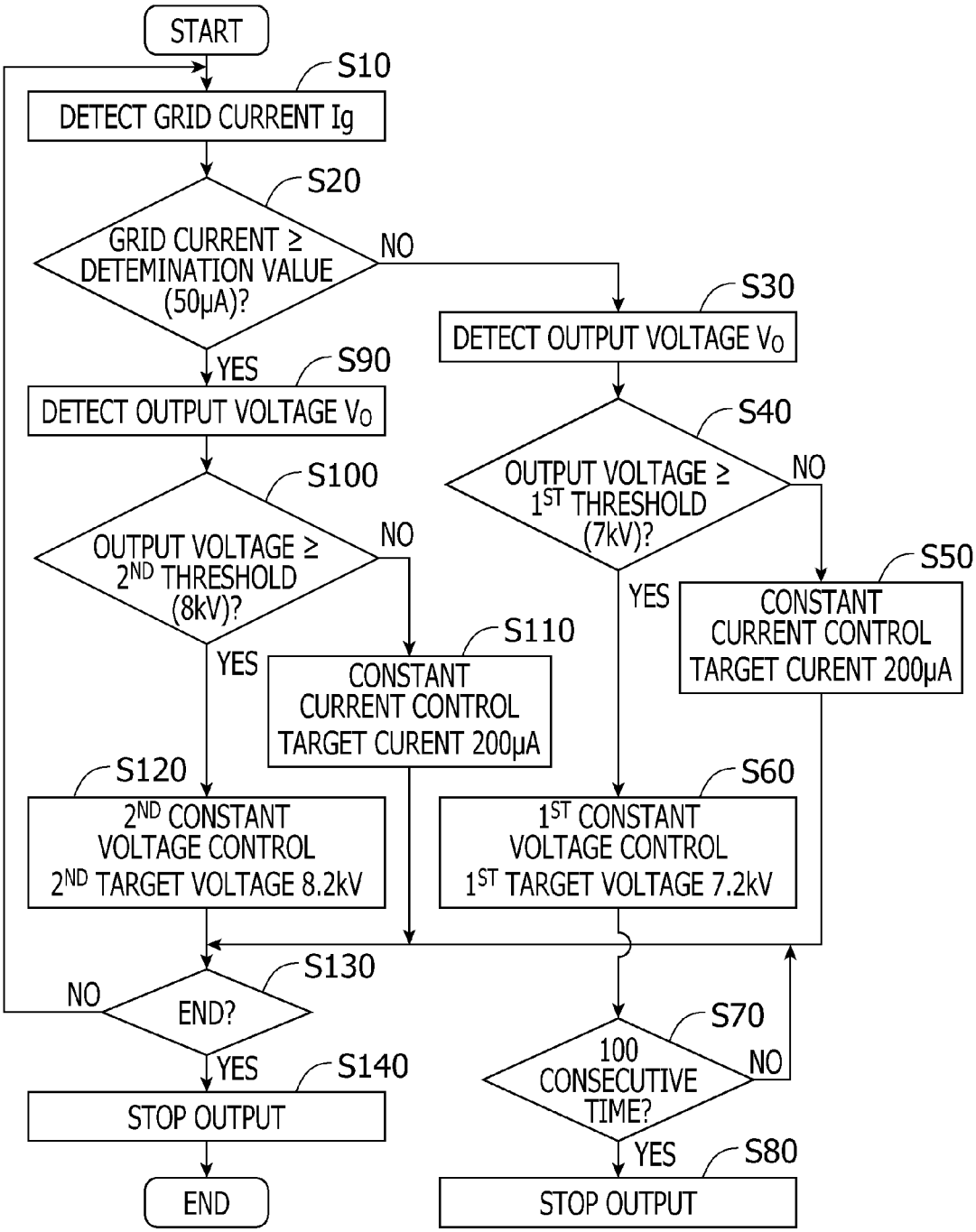
FIG. 6 illustrates a control flow for a charge voltage applying circuit.

Hereafter, a control flow for the charge voltage applying circuit 150 executed by the control device 100 is explained with reference to FIGS. 6 to 8. When print data is outputted, for example, from a host computer, the print data is received by the printer 1 via the communication unit 81. Then, the control device 100 starts the control flow for the charge voltage applying circuit 150.

We assume that, at the time of start of the control flow, the charge voltage applying circuit 150 is in the state of not outputting voltage and no grid current Ig flows, and that the initial PWM value of the PWM signal S1 is zero.

<In Case where the Process Cartridge 18 is Attached to the Attachment Part 2A of the Body Case 2 (a Load Attached State)>

After the control process is started, the control device 100 monitors the voltage level of the input port P3 to detect the grid current Ig (S10). Then, the control device 100 determines whether the grid current Ig is larger than or equal to the determination value of 50 μA (S20).

Since the charge voltage applying circuit 150 outputs no voltage at the time of start of the control flow, no grid current Ig flows. Therefore, when determination is made for the first time in S20, the determination result is "NO", and the process proceeds to step S30. In step S30, the control device 100 monitors the voltage level of the input port P2 to detect the output voltage $V_O$ of the charge voltage applying circuit 150.

Then, the process proceeds to step S40 where the control device 100 determines whether the output voltage $V_O$ of the charge voltage applying circuit 150 is larger than or equal to the first threshold of 7 kV. Since the charge voltage applying circuit 150 outputs no voltage at the time of start of the control flow, no grid current Ig flows and the determination result in step S40 is "NO" when the determination is made in step S40 for the first time. Then, the process proceeds to step S50.

In step S50, the control device 100 adjusts the output voltage $V_O$ of the charge voltage applying circuit 150 so that the grid current Ig becomes the target current of 200 μA, by increasing or decreasing the PWM value of the PWM signal S1. Since the grid current Ig is zero at the time of start of the control flow, the PWM value of the PWM signal S1 is adjusted in a plus direction when step S50 is processed for the first time. As a result, the charge voltage applying circuit 150 moves from the non-output state to an outputting state, and the output voltage $V_O$ starts to increase.

Then, the process proceeds to step S130. In step S130, the control device 100 determines whether the process is finished. When the charge process is not finished, the determination result in step S130 is NO. When the determination result in step S130 is NO, the process returns to step S10 and the steps from S10 are executed again.

During a time period from the start of the control flow to a time when the output voltage $V_O$ of the charge voltage applying circuit 150 reaches the discharge start voltage of 4.5 kV of the charger 29, the state where no grid current Ig flows continues. Therefore, in this state, the determination result in each of steps S20 and S40 is NO. Therefore, in this state, the process is repeated in the order of S10, S20 (NO), S30, S40 (NO) S50, and S130 (NO).

Figure 7:
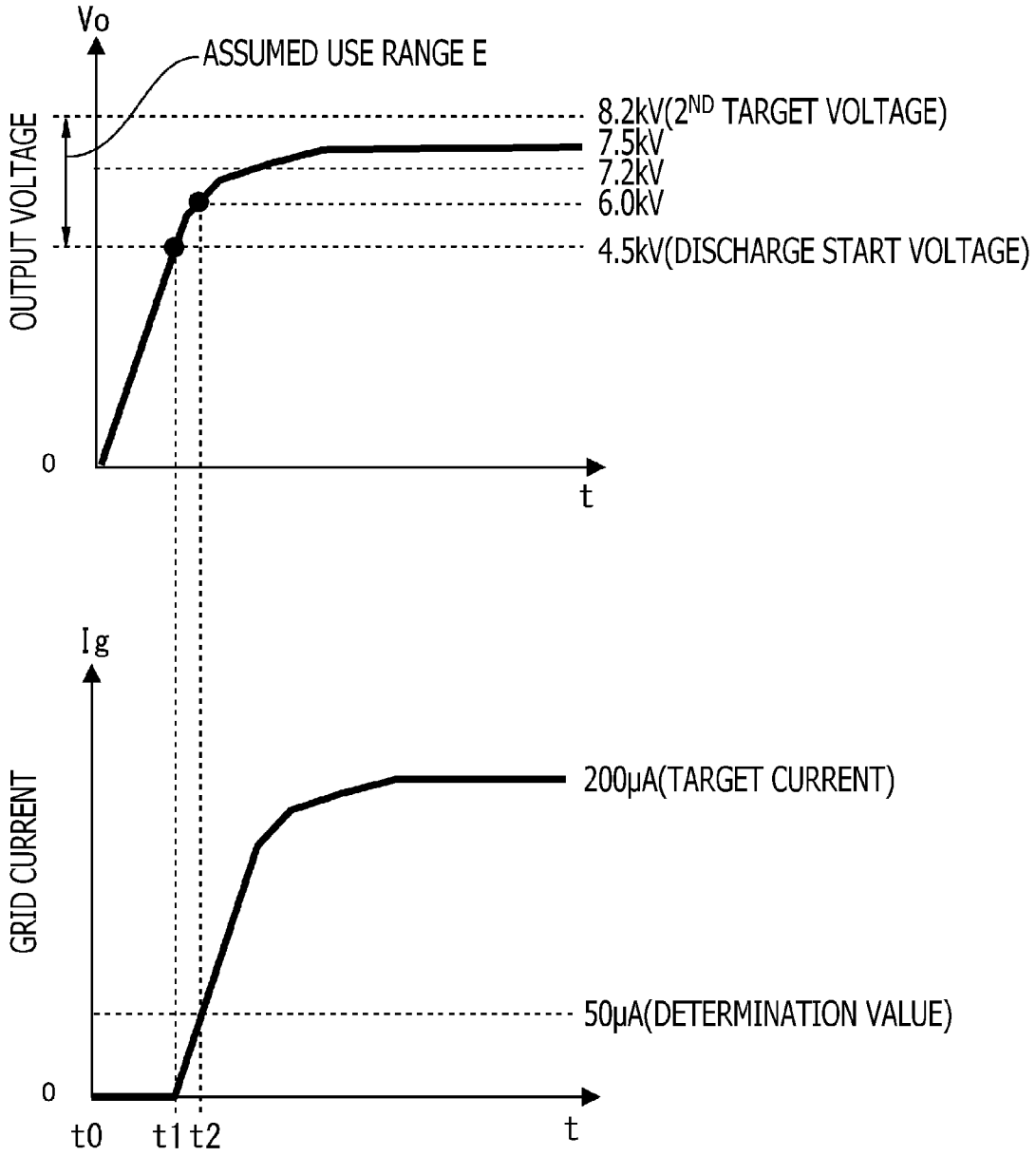
FIG. 7 illustrates graphs showing transition of an output voltage of the charge voltage applying circuit and a grid current during a state where a load is attached.

Since the control device 100 adjusts the PWM value of the PWM signal S1 in a plus direction during repeated execution in the above described order of steps, the output voltage $V_O$ of the charge voltage applying circuit 150 further increases (time t0 to t1 in FIG. 7).

When the output voltage $V_O$ of the charge voltage applying circuit 150 reaches thereafter the discharge start voltage of 4.5 kV, the charger 29 starts to discharge, and then the grid current Ig starts to flow (time t1 in FIG. 7).

During the state where the grid current Ig is smaller than 50 μA continues thereafter, the state where steps S10, S20 (NO), S30, S40 (NO), S50 and 130 (NO) are repeated continues. Since, each time step S50 is executed, the control device 100 adjusts the PWM value of the PWM signal S1 in a plus direction, the output voltage of $V_O$ of the charge voltage applying circuit 150 further increases from 4.5 kV, and the grid current Ig also increases.

When the output voltage $V_O$ of the charge voltage applying circuit 150 increases to 6 kV, the grid current Ig exceeds the determination value of 50 μA (time t2 in FIG. 7). Therefore, when the determination of step S20 is made subsequently, the determination result of S20 becomes YES, and the process proceeds to step S90.

In step S90, the control device 100 monitors the voltage level of the input port P2 to detect the output voltage $V_O$ of the charge voltage applying circuit 150. Then, the process proceeds to step S100 where the control device 100 determines whether the output voltage $V_O$ of the charge voltage applying circuit 150 is larger than or equal to the second threshold.

The second threshold is defined to prevent occurrence of abnormal discharge caused by application of an abnormal high voltage to the discharge wire 29B, and in this example the second threshold is 8 kV.

When the output voltage $V_O$ of the charge voltage applying circuit 150 is smaller than the second threshold of 8 kV, the process proceeds to step S110. In step S110, the control device 100 adjusts the output voltage $V_O$ of the charge voltage applying circuit 150 so that the grid current Ig becomes the target current of 200 μA, by increasing or decreasing the PWM value of the PWM signal S1.

Then, the process proceeds to step S130, and when the process is not finished, the determination result in step S130 is NO. In this case, the process returns to step S10, and the steps from step S10 are executed again.

While the output voltage $V_O$ of the charge voltage applying circuit 150 does not exceed the second threshold of 8 kV after the grid current Ig gets larger than 50 μA (after time t2 in FIG. 7), the process is repeated in the order of S10, S20 (YES), S90, S100 (NO), S110 and S130 (NO), and the output voltage $V_O$ of the charge voltage applying circuit 150 is adjusted so that the grid current Ig becomes the target current of 200 μA (S110: constant current control). As shown in FIG. 7, in this example, when the output voltage $V_O$ of the charge voltage applying circuit 150 has increased to approximately 7.5 kV, the grid current Ig is 200 μA, and thereafter the output voltage $V_O$ becomes stable at 7.5 kV and thus the grid current Ig is kept at 200 μA.

As described above, excepting the case where the output voltage $V_O$ of the charge voltage applying circuit 150 exceeds the second threshold of 8 kV, the grid current Ig is subjected to the constant current control to keep the grid current Ig at 200 μA during execution of the charge process. When the charge process is finished in response to finish of the image formation process, the determination result in step S130 becomes YES. When the determination result in step S130 becomes YES, the process proceeds to step S140 where a process for stopping output of the charge voltage applying circuit 150 is executed, and the above described sequence of process is terminated.

Next, explanation is given for the case where the discharge wire 28B of the charger 29 gets dirty, and thereby the grid current Ig becomes hard to flow.

In the case where the constant current control is performed for the grid current Ig by the control device 100 (S110), the output voltage $V_O$ of the charge voltage applying circuit 150 tends to increase when the grid current Ig becomes hard to flow, because in this case stronger feedback is caused relative to the case where the discharge wire 29B is less dirty and therefore the PWM value of the PWM signal S1 tends to increase.

When the output voltage $V_O$ of the charge voltage applying circuit 150 gets larger than the second threshold of 8 kV, the constant current control (S110) switches to the second constant voltage control (S120). Specifically, the determination result in S100 becomes YES, and the process proceeds to step S120. In step S120, the control device 100 increases or decreases the PWM value of the PWM signal S1 in accordance with the deviation between the detected output voltage $V_O$ and the second target voltage while monitoring the voltage level of the input port P2. Therefore, the output voltage $V_O$ of the charge voltage applying circuit 150 is controlled to be kept at the second target voltage of 8.2 kV (second constant voltage control). Thus, when the discharge wire 29B gets dirty and thereby the grid current Ig becomes hard to flow, the output voltage $V_O$ of the charge voltage applying circuit 150 is suppressed to be smaller than 8.2 kV at the maximum. As a result, it becomes possible to prevent occurrence of abnormal discharge of the charger 29.

<In Case where the Process Cartridge 18 is not Attached (No Load State)>

When the process cartridge 18 is not attached, the process in the order of S10, S20 (NO), S30, S40 (NO), S50 and S130 (NO) is repeated as in the case of the process cartridge 18 is attached. Then, the control device 100 adjusts the PWM value of the PWM signal S1 to increase the PWM value so that the grid current Ig reaches the target current of 200 μA. Therefore, only the output voltage $V_O$ of the charge voltage applying circuit 150 increases while no grid current Ig flows.

When the output voltage $V_O$ of the charge voltage applying circuit 150 exceeds the first threshold of 7 kV, control is switched from the constant current control (S50) to the first constant voltage control (S60) (time t3 in FIG. 8).

Specifically, the determination result in S40 becomes YES, and then the process proceeds to step S60. In step S60, the control device 100 increases or decreases the PWM value of the PWM signal S1 in accordance with the deviation X between the detected output voltage $V_O$ and the first target voltage, while monitoring the voltage level of the input port P2. As a result, the output voltage $V_O$ of the charge voltage applying circuit 150 is controlled to be kept at the first target voltage of 7.2 kV (first constant voltage control).

After processing step S60, the process proceeds to step S70 where the number of times of YES determinations is calculated. Until the number of times of YES determinations reaches 100 times, the determination result in S70 is NO, and therefore the process returns to step S10.

Thus, in the case where the process cartridge 18 is not attached, when the output voltage $V_O$ of the charge voltage applying circuit 150 exceeds the first threshold of 7 kV, the process in the order of S10, S20 (NO), S30, S40 (YES), S60, S70 (NO) and S130 is repeated, and the output voltage $V_O$ of the charge voltage applying circuit 150 is subjected to the constant voltage control to be kept at the first target voltage of 7.2 kV.

When 100 consecutive YES determinations are made in S40, the determination result in S70 becomes YES, and the process proceeds to step S80 where the control device 100 determines that the present status is abnormal and stops output of the charge voltage applying circuit 150. Thus, the sequence of process is terminated. In order to make a determination in step S70, the control device 100 may stores the determination result (YES/NO) in S40 in the RAM 105 each time the control device 100 makes a determination in step S40.

6. Explanation about Advantageous Effects

When the grid current Ig is subjected to the constant current control in the state of no load, the control device 100 rapidly increases the PWM value of the PWM signal S1, and therefore the output voltage $V_O$ of the charge voltage applying circuit 150 might increase to the maximum output value (10 kV in this example).

By contrast, according to the printer 1, the grid current Ig and the output voltage Vo are monitored during the constant current control, and when the both the above described conditions (1) and (2) are satisfied, control of the charge voltage applying circuit 150 is switched from the constant current control to the first constant voltage control. By switching to the first constant voltage control, the output voltage $V_O$ of the charge voltage applying circuit 150 is controlled to be kept at the first target voltage of 7.2 kV. Therefore, the output voltage $V_O$ of the charge voltage applying circuit 150 does not increase to the maximum output value of 10 kV, and thereby it becomes possible to suppress the peak of the output voltage $V_O$ of the charge voltage applying circuit 150.

In addition, as shown in a part A in FIG. 8, the output voltage $V_O$ converges to the first target voltage of 7.2 kV while causing overshoot after switching of control. Therefore, in order to suppress the peak, it becomes necessary to suppress the overshoot. At the time of switching to the first constant voltage control, the output voltage $V_O$ of the charge voltage applying circuit 150 is 7 kV which is lower than the first target voltage of 7.2 kV. Therefore, in this case, the charge voltage applying circuit 150 is adjusted by the control device 100 to increase the output voltage. However, as the output voltage $V_O$ increases, the deviation with respect to the first target voltage becomes small, and a weak level of feedback is caused. As a result, the increasing curve (a curve indicated by a solid line in FIG. 9) of the output voltage $V_O$ of the charge voltage applying circuit 150 becomes gentler than the increasing curve (a curve indicated by a chain line in FIG. 9) during the constant current control. Consequently, the overshoot of the output voltage $V_O$ becomes small.

In the printer 1, the first target voltage for the first constant voltage control is set to be smaller than the second target voltage for the second constant voltage control. Specifically, the second target voltage is 8.2 kV, and the first target voltage is 7.2 kV which is smaller by 1 kV than the second target voltage.

Therefore, although it is necessary to store two types of target voltages, the output voltage $V_O$ can be kept at a lower voltage in comparison with the case where only the second target voltage is used as a target (i.e., the case where the second target voltage is used even in the case of the first constant voltage control). As a result, it becomes possible to suppress the peak of the output voltage $V_O$.

In addition, the deviation X between the output voltage $V_O$ and the target voltage becomes smaller in comparison with the case where only the second target voltage is used as a target voltage (i.e., the case where the second target voltage is used even in the case of the first constant voltage control) after switching to the first constant voltage control. Therefore, a weak level of feedback is applied, and the overshoot of the output voltage Vo becomes further smaller.

The graph indicated by a dashed line in FIG. 8 shows change of the output voltage $V_O$ generated when the second target voltage (8.2 kV) is defined as the target voltage during the first constant voltage control. From this graph, it is understood that the level of overshoot is larger in comparison with the case where the first target voltage is set as the target voltage, In the printer 1, the first target voltage is set to be larger than the first threshold. Specifically, the first threshold is 7 kV, and the first target voltage is set for 7.2 kV which is larger by 0.2 kV than the first threshold. Thus, by setting the first target voltage to be larger than the first threshold, it is possible to prevent the control from frequently switching between the constant current control and the first constant voltage control.

In the case where the process cartridge 18 is properly attached, when the output voltage $V_O$ gets larger than the first threshold of 7 kV, the grid current Ig of approximately 100 μA flows, and therefore the grid current Ig is larger than 50 μA. Therefore, when the process cartridge 18 is properly attached, the control for the charge voltage applying circuit 150 does not switch unintentionally from the constant current control to the first constant voltage control.

In this embodiment, the first threshold is set to be higher than the discharge start voltage of the discharge wire 29B. Therefore, control for the charge voltage applying circuit 150 does not change to the first constant voltage control unless the output voltage $V_O$ of the charge voltage applying circuit 150 exceeds the discharge start voltage. Therefore, when the scorotron charger 29 is properly attached, control for the charge voltage applying circuit 150 does not unintentionally change from the constant current control to the first constant voltage control until the discharge wire 29B starts to discharge.

Other Embodiments

The present invention is not limited to the above described illustrative embodiment explained with reference to the accompanying drawings, but other embodiment indicated below are also included within the scope of the invention.

(1) In the above described embodiment, the control device 100 is configured to include the CPU 101, the ROM 103, and the RAM 105; however, the control device 100 may include one or more pieces of hardware circuits, such as an ASIC (Application Specific Integration Circuit) or may be constituted by a combination of a CPU and hardware circuit.

(2) In the above described embodiment, a charger is explained as an example of a load for image formation, and a charge voltage applying circuit is explained as an applying circuit. However, for example, a transfer roller may be defined as a load and a transfer voltage applying circuit may be defined as an applying circuit.

(3) In the above described embodiment, a process for stopping output of the charge voltage applying circuit is explained as an error process; however, as another example of an error process a message indicating "process unit unattachment error" may be displayed. In the above described embodiment, the error process is executed when 100 consecutive YES determinations are made in step S40; however, the error process may be executed when a plurality of times of consecutive YES determinations are made in step S40. By defining a condition that at least a plurality of times of YES determinations need to be made in step S40 as an execution condition for executing the error process, it becomes possible to prevent the error process from being erroneously executed when a process unit, i.e., a load, is attached.

(4) In the above described embodiment, a monochrome type laser printer is explained as an example of the image forming apparatus; however, the printer may be an electrophotographic printer, such as a color laser printer. Further, in the above described embodiment, a positive high voltage is applied to a charger and a photosensitive drum is positively charged; however, a negative high voltage may be applied to the charger and the photosensitive drum may be negatively charged.

(5) In the above described embodiment, the first target voltage (7.2 kV) is set for the first constant voltage control, and the second target voltage (8.2 kV) is set for the second constant voltage control; however, a common target voltage may be used for the two constant voltage control by setting the target voltage of the first constant voltage control for 8.2 kV.

(6) In the above described embodiment, the second constant voltage control is performed in addition to the first constant voltage control; however, the second constant voltage control may be omitted. In this case, the process of steps S90 to S110 are omitted, and when the determination result of step S20 becomes YES, the process may proceeds to step S110.

What is claimed is:

1. An image forming apparatus, comprising:

an attachment unit to which a load is attached;

an applying circuit configured to apply an applying voltage to the load attached to the attachment unit;

a voltage detection circuit configured to detect the applying voltage outputted by the applying circuit;

a current detection unit configured to detect a load current produced by application of the applying voltage to the load by the applying circuit; and a control device, wherein the control device is configured to:

subject the applying circuit to constant current control in accordance with a detected value of the current detection unit so that the load current for the load becomes a target current;

switch to a constant voltage control by which the applying voltage is controlled to become a target voltage when an absolute value of the load current detected by the current detection unit is smaller than a determination value and an absolute value of the applying voltage detected by the voltage detection circuit is larger than or equal to a threshold during execution of the constant current control; and switch control for the applying circuit from the constant current control to an additional constant voltage control by which the applying voltage is controlled to become an additional target voltage when the absolute value of the load current detected by the current detection unit is larger than or equal to the determination value and the absolute value of the applying voltage detected by the voltage detection circuit is larger than or equal to an additional threshold which is larger than the threshold.

2. The image forming apparatus according to claim 1, wherein the absolute value of the target voltage is smaller than the absolute value of the additional target voltage.

3. The image forming apparatus according to claim 1, wherein the absolute value of the target voltage is larger than the absolute value of the threshold.

4. The image forming apparatus according to claim 1, wherein:

the load comprises a scorotron charger that has a discharge wire and a grid electrode and is configured to change a photosensitive body;

the applying circuit comprises a charge voltage applying circuit configured to apply the applying voltage to the discharge wire of the scorotron charger attached to the attachment unit;

the voltage detection circuit is configured to detect the applying voltage outputted by the charge voltage applying circuit; and the current detection unit is configured to detect a grid current flowing from the discharge wire to the grid electrode due to application of the applying voltage.

5. The image forming apparatus according to claim 4, wherein the threshold is higher than a discharge voltage at which the discharge wire starts to discharge due to application of the applying voltage.

6. An image forming apparatus, comprising:

an attachment unit to which a load is attached;

an applying circuit configured to apply an applying voltage to the load attached to the attachment unit;

a voltage detection circuit configured to detect the applying voltage outputted by the applying circuit;

a current detection unit configured to detect a load current produced by application of the applying voltage to the load by the applying circuit; and a control device, wherein the control device is configured to:

subject the applying circuit to constant current control in accordance with a detected value of the current detection unit so that the load current for the load becomes a target current;

switch to a constant voltage control by which the applying voltage is controlled to become a target voltage when an absolute value of the load current detected by the current detection unit is smaller than a determination value and an absolute value of the applying voltage detected by the voltage detection circuit is larger than or equal to a threshold during execution of the constant current control; and after controlling the applying circuit to switch to the constant voltage control, execute a process to detect the applying voltage of the applying circuit and the load current based on detection values of the voltage detection circuit and the current detection unit, and execute an error process when a state where the absolute value of the load current is smaller than the determination value and the absolute value of the applying voltage is larger than or equal to the threshold is detected a plurality of times.

7. The image forming apparatus according to claim 6, wherein the absolute value of the target voltage is larger than the absolute value of the threshold.

8. The image forming apparatus according to claim 6, wherein:

the load comprises a scorotron charger that has a discharge wire and a grid electrode and is configured to change a photosensitive body;

the applying circuit comprises a charge voltage applying circuit configured to apply the applying voltage to the discharge wire of the scorotron charger attached to the attachment unit;

the voltage detection circuit is configured to detect the applying voltage outputted by the charge voltage applying circuit; and the current detection unit is configured to detect a grid current flowing from the discharge wire to the grid electrode due to application of the applying voltage.

9. The image forming apparatus according to claim 8, wherein the threshold is higher than a discharge voltage at which the discharge wire starts to discharge due to application of the applying voltage.

* * * * *